US008028637B2

(12) United States Patent
Fong et al.

(10) Patent No.: US 8,028,637 B2
(45) **Date of Patent: *Oct. 4, 2011**

(54) METHOD OF INTERCEPTING AND YAWING A SAILING VESSEL WITH EXTERNAL PROPULSION MEANS

(75) Inventors: Saik Hay Fong, Singapore (SG); Hong Soon Tan, Singapore (SG); Tee Peng Toh, Singapore (SG)

(73) Assignee: Singapore Technologies Dynamics PTE Ltd, Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 12/087,396

(22) PCT Filed: Jan. 11, 2007

(86) PCT No.: PCT/SG2007/000008

§ 371 (c)(1),
(2), (4) Date: Jul. 3, 2008

(87) PCT Pub. No.: WO2007/081292

PCT Pub. Date: Jul. 19, 2007

(65) Prior Publication Data

US 2009/0013916 A1 Jan. 15, 2009

(30) Foreign Application Priority Data

Jan. 11, 2006 (SG) ..... 200600202-6

(51) Int. Cl.
*B63B 21/58* (2006.01)

(52) U.S. Cl. ..... 114/249

(58) Field of Classification Search ..... 114/242, 114/246, 245, 248, 249, 251, 253, 254
See application file for complete search history.

(56) References Cited

U.S. PATENT DOCUMENTS 3,345,971 A * 10/1967 Stanwick ..... 114/242

(Continued)

FOREIGN PATENT DOCUMENTS

DE 2360230 11/1975

(Continued)

OTHER PUBLICATIONS

International Search Report dated Jun. 15, 2007 based on PCT application No. PCT/SG2007/000008.

*Primary Examiner* — Daniel Venne

(74) *Attorney, Agent, or Firm* — Ohlandt, Greeley, Ruggiero & Perle, L.L.P.

(57) ABSTRACT

A method for intercepting and yawing an errant sailing vessel is disclosed, wherein the vessel might have been hijacked or malfunctioned and in danger of colliding with an object. The method comprises dispatching a watercraft to approach the sailing vessel and secures itself to one side of the sailing vessel's hull. Preferably, a second watercraft is secured to the other side of the vessel's hull. At least one of the watercrafts is then operated to direct propulsion thrust to yaw the vessel in a desired direction. Preferably still, the first and second watercrafts are each secured respectively to the right and left sides of the vessel's hull proximate to the stem or bow end. The first (right side) watercraft then operates a fluid propulsion which thrust is directed away from the vessel's right side while the second (left side) watercraft's propulsion is on standby. As a result, the vessel is turned rightward or clockwise. Conversely, the first watercraft may be put on standby while the second watercraft's propulsion is operated such that the thrust is directed away from the vessel's left side, thereby causing the vessel to turn leftward or anti-clockwise.

10 Claims, 6 Drawing Sheets

U.S. PATENT DOCUMENTS

| | | | | |
|---|---|---|---|---|
| 3,494,318 | A | 2/1970 | Katsumura | 114/246 |
| 3,750,607 | A * | 8/1973 | Seymour et al. | 114/65 R |
| 4,949,663 | A * | 8/1990 | Lapeyre | 114/246 |
| 5,111,763 | A * | 5/1992 | Moerbe | 114/246 |
| 6,325,015 | B1 | 12/2001 | Garcia et al. | 114/382 |
| 6,413,128 | B2 | 7/2002 | Brabeck | 440/66 |
| 6,591,774 | B2 | 7/2003 | Metherell et al. | 114/241 |
| 6,698,374 | B1 | 3/2004 | Van Der Laan | 114/253 |
| 7,748,338 | B2 * | 7/2010 | Chia et al. | 114/253 |

FOREIGN PATENT DOCUMENTS

| | | |
|---|---|---|
| WO | WO 2005/118390 A1 | 12/2005 |

* cited by examiner

METHOD OF INTERCEPTING AND YAWING A SAILING VESSEL WITH EXTERNAL PROPULSION MEANS

Co-pending International Patent Application No. PCT/SG2005/000178 filed on 3 Jun. 2005 which disclosure is incorporated herein by reference.

TECHNICAL FIELD

This invention relates to a method of intercepting a sailing vessel and yawing it to force a change in direction of sail. It is directed to regaining control of sail direction of an errant or malfunctioned vessel.

BACKGROUND ART

In post-Sep. 11, 2001 terrorist attacks on New York City which has heightened fears of man-made disasters and terrorist acts, it has been envisaged that ships and large vessels may be used to attack and destroy harbors and seafront installations such as oil refineries, chemical plants, etc. or another sea-borne object such as oil rig or a passenger ship. As some of the ships and vessels may be carrying flammable or inflammable materials, such as crude oil or refined petroleum products, they might be hijacked by terrorists and set on course to collide with these targets of attack. If the vessel is large enough, its massive moving mass may create a momentum large enough to cause destruction by sheer collision onto a target.

Accordingly, it is imperative that methods are available for preventing such attacks and that the errant or malfunctioning vessel be quickly controlled and yawed to avoid colliding with the targets or being used as a weapon of massive destruction.

U.S. Pat. No. 6,591,774 discloses a barrier system for protecting ships and harbors from attack by vessels. The barrier system is constructed around the ships or harbor to be defended. The barrier may either be floating on the surface above and/or beneath the surface of the water. When a vessel attempts to force its way through the barrier, the barrier uses the momentum of the vessel against itself by using the forward momentum of the attacking vessel in such a manner as to divert, impede, stop, damage or destroy the vessel. This system however may only be suitable for stopping a small attacking vessel and may not be suitable for arresting, large shipping vessels.

U.S. Pat. No. 6,413,128 discloses a device for changing the direction of travel of a watercraft. The device includes a gondola-like underwater housing having a container favorable in terms of flow outside the hull by the watercraft, and is connected to the hull of the watercraft by a shaft. The change in direction of travel of the watercraft is brought about by a pivoting motor acting on the shaft, and the use of high energy fluid jets in the gondola-like structure. The latter is a permanent device attached to the watercraft to enhance steering at low noise.

U.S. Pat. No. 6,698,374 discloses a tugboat design with a towing installation having a 360° turning to steer and guide a large shipping vessel. There is no disclosure on means of attaching the tow rope to a vessel to be towed, especially a large vessel such as a hijacked one, as access to the vessel would be denied.

It is therefore desirable that a method be provided to effectively intercept an errant or malfunctioned vessel from crashing into a seaside installation or sea-borne target of terrorist attacks or mishaps resulting from vessel malfunction. As some of these vessels may be of a huge size and tonnage, and carrying flammable cargo such as petroleum products, it is essential that any such method is effective in changing the course of direction of the vessel as quickly and in the shortest distance as possible. Preferably, such methods are able to achieve a turning radius of 2 km.

Any discussion of documents, devices, acts or knowledge in this specification is included to explain the context of the invention. It should not be taken as an admission that any of the material forms a part of the prior art base or the common general knowledge in the relevant art in Singapore or elsewhere on or before the priority date of the disclosure and claims herein. All statements as to the date or representation as to the contents of these documents is based on the information available to the applicant and does not constitute any admission as to the correctness of the dates or contents of these documents.

SUMMARY OF DISCLOSURE

In accordance with the above objects, a method is provided herein for intercepting and yawing a sailing vessel comprising the steps of dispatching at least a first watercraft to approach the sailing vessel, securing the first watercraft to one side of said sailing vessel's hull, operating said first watercraft to direct propulsion to yaw said vessel in a desired direction. Preferably, at least a second watercraft may be further despatched to approach said sailing vessel. The first watercraft may be secured to one side of said sailing vessel's hull while the second watercraft may be secured to the other side of said vessel's hull. At least one of the watercrafts may then be operated to direct propulsion to yaw said vessel in a desired direction.

In one embodiment of the invention, the first watercraft is secured proximate to sailing vessel's stern and operated to direct propulsion away from said vessel's hull to yaw said sailing vessel to a direction on same side of the hull to which said first watercraft is secured. Preferably, a second watercraft is secured proximate to sailing vessel's stern but is not operated to direct propulsion with respect to said vessel's direction of sailing vessel. When the direction needs to be changed midway of yawing, the first watercraft's direct propulsion may be halted and the second watercraft second watercraft is operated to direct propulsion away from said vessel's hull so that the sailing vessel is yawed to a direction on the same side of the hull to which the second watercraft is secured.

In a second alternative embodiment, where the direction of yawing is predetermined, the first watercraft may be secured on one side of the sailing vessel's hull proximate to the stern and operated to direct propulsion away from said vessel's hull while the second watercraft is secured on the other side of the sailing vessel's hull proximate to the bow and operated to direct propulsion away from the vessel's hull.

In a third alternative embodiment, where the direction of yawing is predetermined, the first watercraft may be secured on one side of the sailing vessel's hull proximate to the stern and operated to direct propulsion in away from to push against said vessel's hull. The second watercraft may be secured on the same side of the sailing vessel's hull proximate to the bow and operated to direct propulsion to pull said vessel's hull towards said second watercraft.

In one aspect of the invention, the watercrafts is secured to the side of sailing vessel's hull by temporary non-destructive releasable attachment means including any one or combination of electromagnetic means, vacuum suction means, or mechanical clamping or hook means. Fast acting securing means to secure said watercraft to the hull in a permanent or secure manner may also be employed, including employing explosive-propelled hull-piercing mechanical clamping means.

In one alternative embodiment, the watercraft may undertake operations involving personnel, including rescuing, evacuating, storming and the like wherein said watercraft is capable of freeing itself from said sailing vessel upon completing the undertaking.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

LIST OF ACCOMPANYING DRAWINGS

The present invention will now be described in detail with reference to the accompanying drawings that follows, wherein specific embodiments are described as non-limiting examples or illustrations of the workings of the invention, in which.

DETAILED DESCRIPTION OF SPECIFIC EMBODIMENTS

Figure 1:
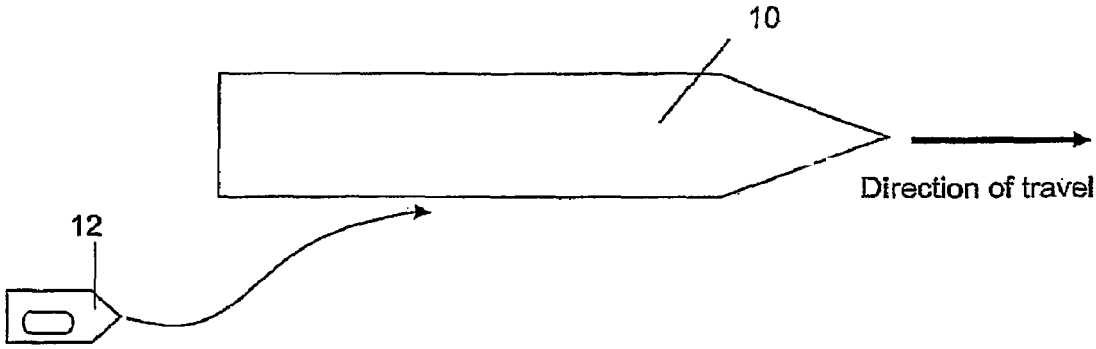
FIG. 1 shows a plan view of one aspect of our method in an early stage wherein a first watercraft approaches an errant vessel.

The general embodiment of our method for intercepting and yawing a sailing vessel comprises dispatching at least a first watercraft to approach the sailing vessel, securing the first watercraft to one side of said sailing vessel's hull, and operating the first watercraft to direct propulsion to yaw said vessel in a desired direction. Our preferred embodiment, however, as shown in FIG. 1, comprises dispatching at least a pair of watercrafts after the errant vessel. Accordingly, in relation to the general embodiment, at least a second watercraft (14) is further despatched to approach the sailing vessel (10). The first watercraft (12) is secured to one side of said sailing vessel's hull while at least a second watercraft (14) is secured to the other side of the vessel's hull. At least one of the watercrafts (12, 14) is then operated to direct propulsion to yaw said vessel in a desired direction. Depending on the propulsion means equipped on the operative watercraft, it may preferably be secured on the side of the hull in which the direction of the vessel is to be yawed.

Hence, in the example of FIG. 1, the first watercraft (12) may be secured to the right side of the hull if the vessel's direction is to be changed to the right or to be turned clockwise. Preferably, the first watercraft is secured proximate to sailing vessel's stern and operated to direct propulsion away from said vessel's hull. In this arrangement, the sailing vessel (10) may be yawed to a direction on same side of the hull to which the first watercraft is secured.

In one embodiment, the second watercraft (14) may approach the vessel, also from the rear, on the other side of the vessel's hull and secure itself thereto. As the watercrafts are equipped with directional propulsion means, as described in the following, they can also approach the vessel from the front.

To commence the yawing task, one or more of the watercrafts (12, 14) which have been attached to the hull of the errant vessel operates its propulsion in an appropriate direction to yaw the vessel in the desired. direction.

Figure 5:
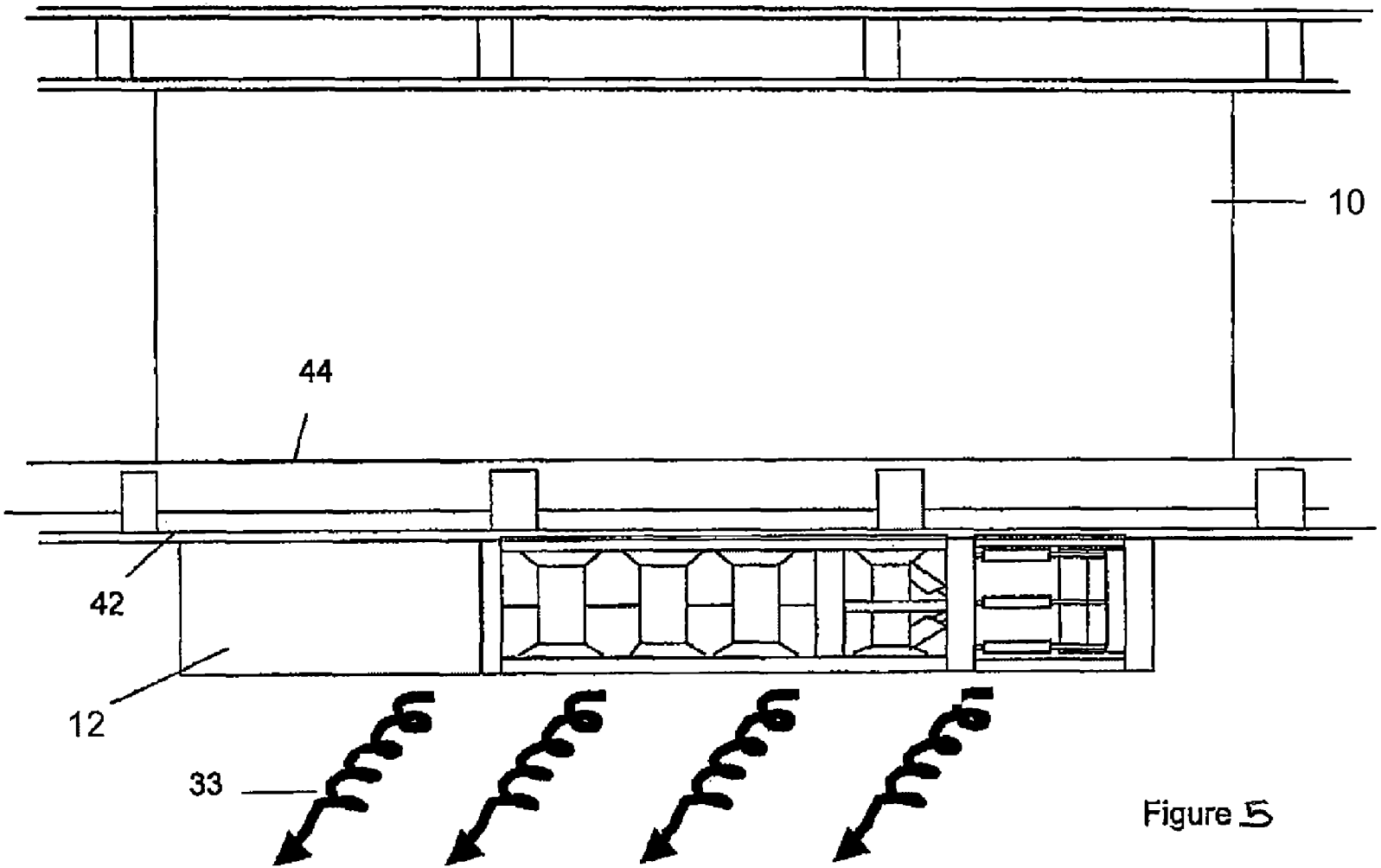
FIG. 5 illustrates schematically a plan view of the watercraft parked alongside the vessel to be in close contact by lateral waterjets.

Depending on the propulsion means equipped on each of the watercrafts, the appropriate direction of yawing may be controlled by the watercraft crew. Conventional propulsion means may be employed. FIG. 5 shows an example of how a watercraft may maintain close contact or proximity with the sidewall of the vessel. The action of the water jets 33 will take the watercraft inwards towards the sidewall of the vessel 10, so that the wall of the watercraft is in contact with the wall of the vessel 10. The watercraft may also be unmanned and remotely controlled from a safe distance rather than having a crew on board as the operation can be dangerous.

An example of a water jet propulsion system is the WARTSILA LJ150E or LJ200E series water jet propulsion unit. Two such units may be installed on a watercraft for use in the presently proposed method.

An example of a steerable propeller system is the SCHOTTEL rudder propeller unit having a rating of 6000 kW. Two units of this propeller system may be installed on a watercraft for this proposed method.

It is estimated that with a vessel length of 276 m and 40 m wide with a design draft of 12 m, the vessel's displacement tonnage may be estimated to be in the region of 73,000 metric tonnes. A vessel this mass and size travelling at 15 knots may be yawed by a watercraft equipped with a pair of any one of the above propulsion systems so that the vessel may be turned within a radius of 2 km.

Figure 2:
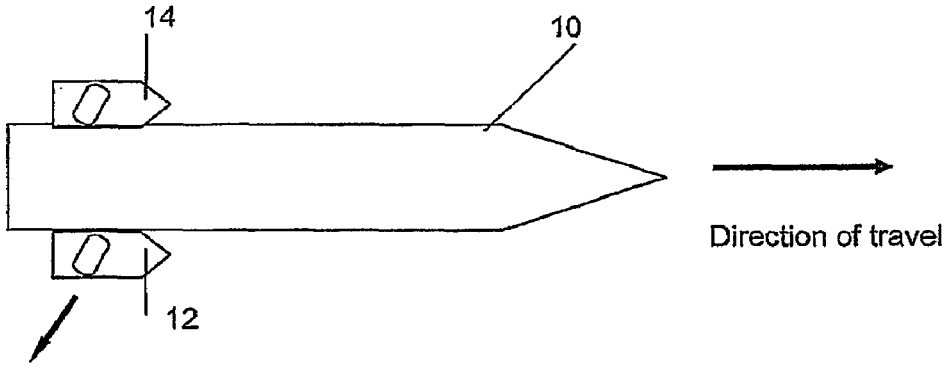
FIG. 2 shows a plan view of another aspect of our method in which two watercrafts are used to yaw an errant sailing vessel.
Figure 3:
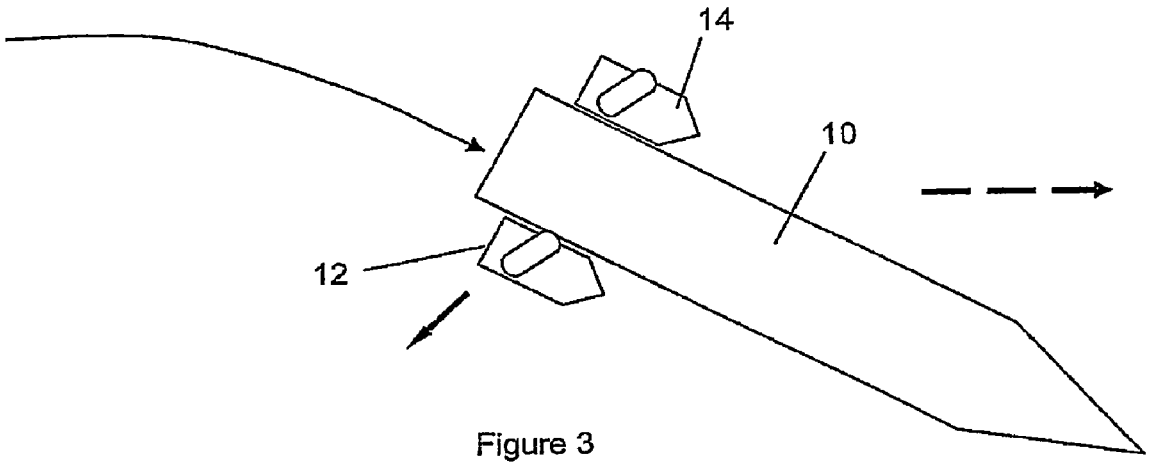
FIG. 3 shows in plan view of the embodiment according to FIG. 2 in which the vessel is being yawed from its original direction of sail.

In another embodiment, in collective reference to FIG. 2 and FIG. 3, a second watercraft may be secured proximate to the sailing vessel's (10) stern. This second watercraft (14) may or may not have its water propulsion means operable to yaw the vessel or to provide propulsion in a manner complementary to the efforts of the first watercraft (12). In other words, the second watercraft (14) may be secured to the vessel's hull and be placed on 'standby'.

Each of the watercraft may be provided with separate propulsion for its own normal navigation while having directional propulsion means to be used solely for the yawing of the errant vessel. In the alternative, however, a single propulsion system may be installed on the watercraft for both navigation purpose and yawing of the vessel.

When circumstances dictate that a change in the direction of yawing is necessary, the second watercraft (14) may be operable to provide the requisite propulsion while the first watercraft (12)'s propulsion operation is halted. With reference to FIG. 2, to change the vessel, which was first shown being yawed to turn clockwise, to turn anticlockwise or to turn to the left of the original course of sail, the second watercraft (14) may now be operated to provide propulsion which direction of thrust is away from the vessel's hull while the first watercraft's propulsion is halted.

Accordingly, with two watercrafts secured on either side of the vessel to be yawed, the vessel may be propelled and steered by external force despite not having control of the vessel's own propulsion or steering. With the external propulsion being provided alternatingly by the two watercrafts, the vessel may even be maneuvered between obstacles such as other moored ships, sandbars, buoys, etc.

In another aspect of our invention, where the direction of the vessel to be yawed to is predetermined and is unlikely to change or to be adjusted midway, the first watercraft (12) may be secured on one side of the sailing vessel's hull proximate to the stern and the second watercraft (14) may be secured on the other side of the sailing vessel's hull proximate to the bow. In this arrangement of diagonally opposing sides of the hull, the first watercraft (12) may be operable to direct propulsion away from said vessel's hull while the second watercraft (14) may be operable to direct propulsion away from said vessel's hull. Such arrangement, whereby the stern is yaw in one direction and the bow in the other, will enable the vessel's direction of sail to be changed in a much shorter distance. The direction of the vessel to be altered or yawed may be predetermined since it is envisaged that a large turning radius is required due to the momentum of the vessel.

Figure 4:
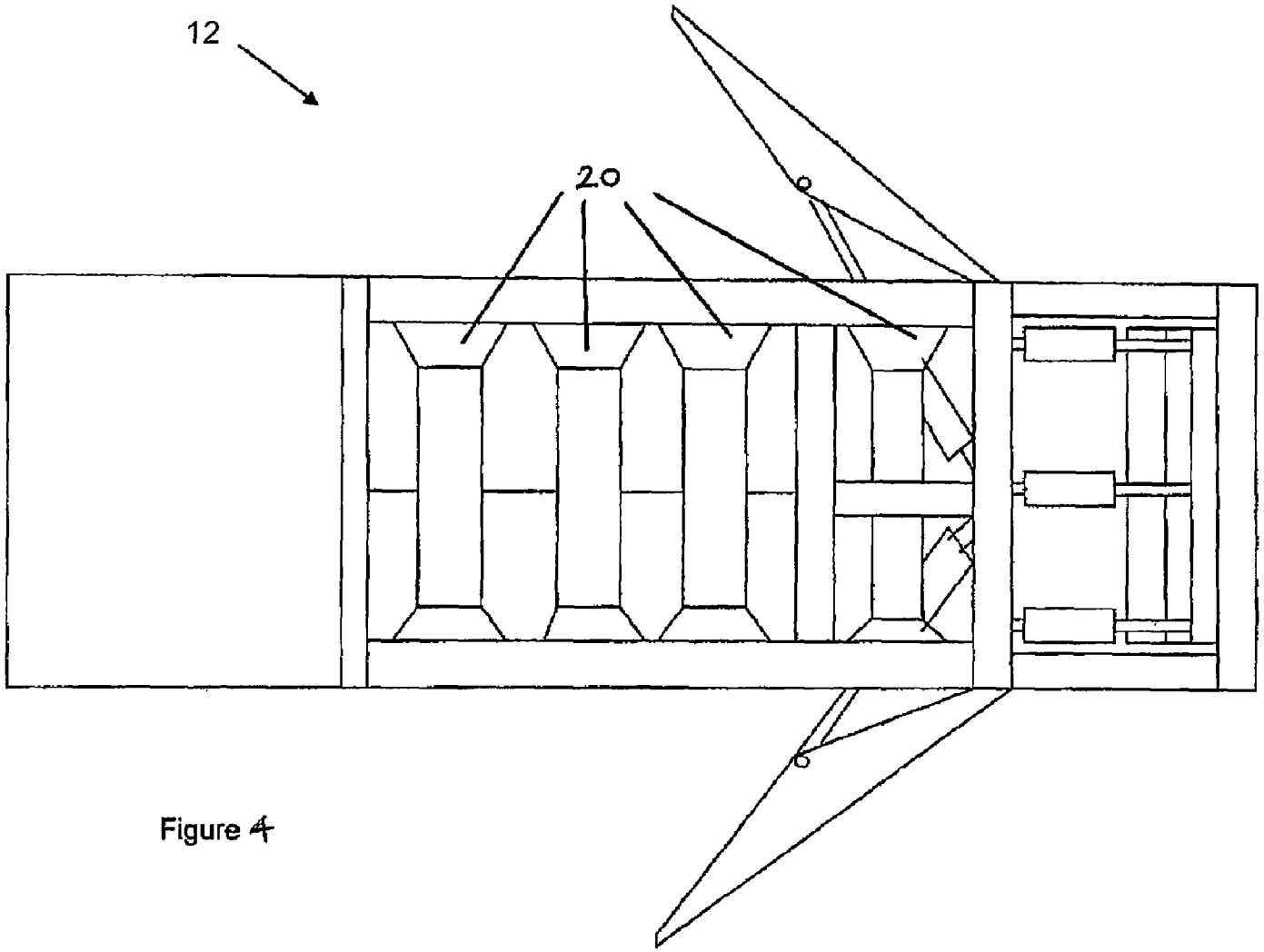
FIG. 4 illustrates schematically a plan view of a watercraft.

The watercraft according to this invention can be of multiple designs. An example watercraft 12 is as shown in FIG. 4. The watercraft includes a plurality of solenoid banks 20. Each solenoid bank may be mounted with the longitudinal axis of its shaft mounted widthwise of the watercraft. The terminal edge of each solenoid bank 20 is in contact with the side walls of the watercraft 12.

Figure 6:
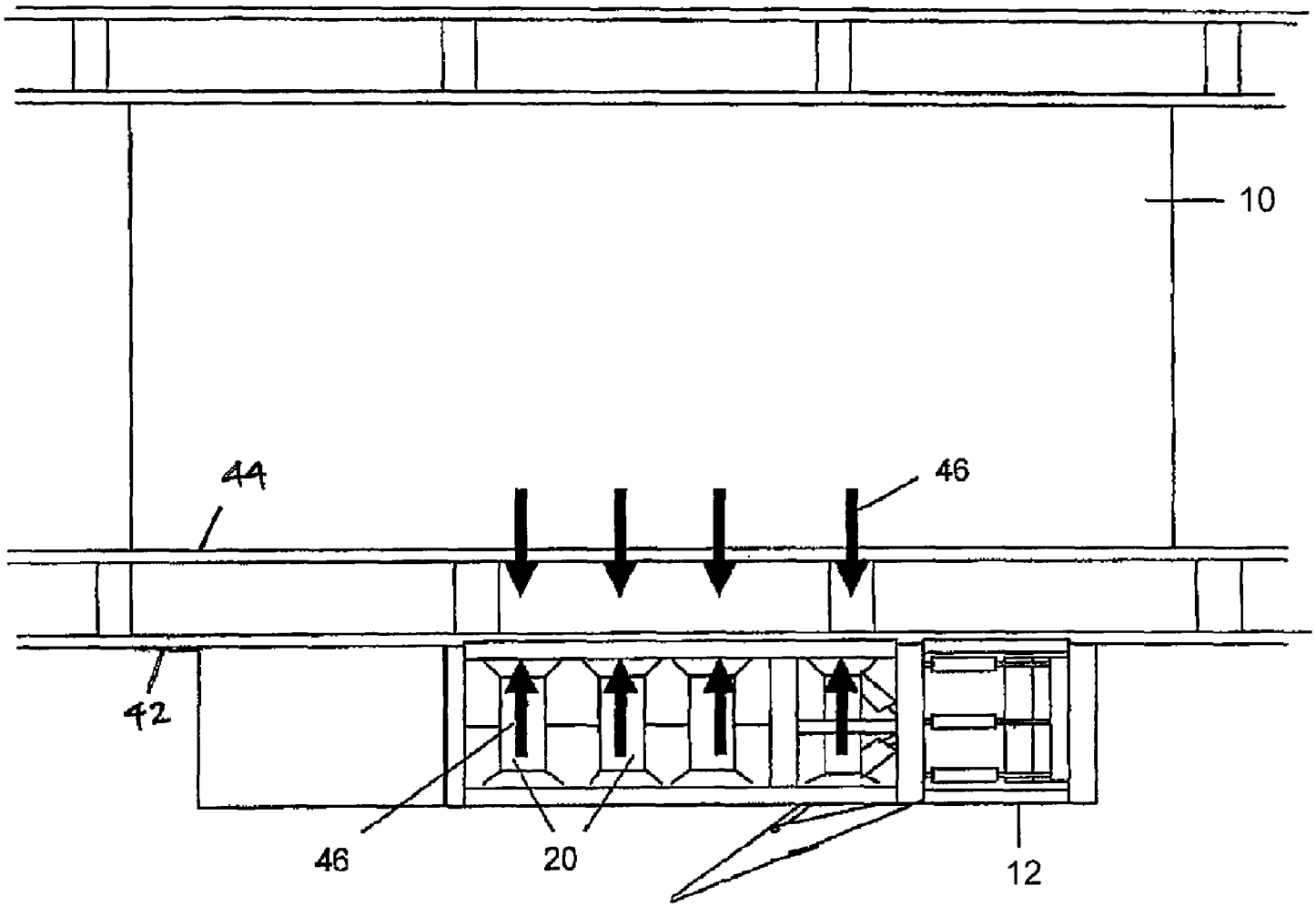
FIG. 6 illustrates schematically a plan view of the diversion watercraft, the vessel and the electromagnetic attraction between the watercraft and the vessel.

Referring to FIG. 6, when the watercraft reaches the desired section of the vessel, an electromagnetic attraction between the watercraft 12 and the vessel 10 will be generated through powering up a series of heavy-duty solenoid banks 20 that are installed within the watercraft 12. The electromagnetic force 46, generated by the plurality of solenoid banks 20 will temporarily secure the watercraft 12 to the vessel at the desired location of the vessel, preferably the stern side, to create the maximum moment arm for turning. Alternatively, the vessel can be mechanically clamped. Once mechanically fastened, the watercraft 12 is inseparable from the vessel.

Figure 7:
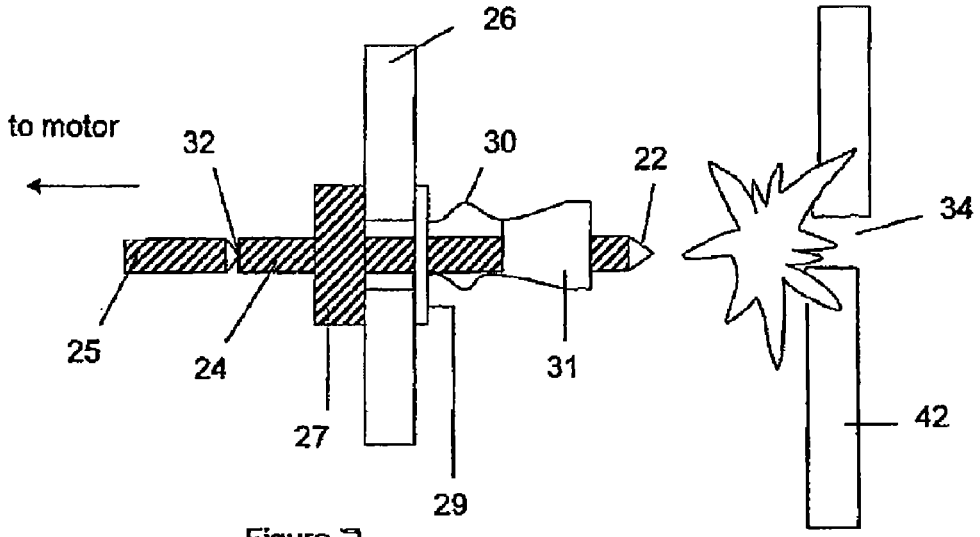
FIG. 7 illustrates explosive at bolt's tip to create an opening at a hijacked vessel's hull.

Referring to FIG. 7, the watercraft 12 further includes a plurality of means to discharge explosive 22 disposed at the tip of bolt 24. The bolts 24 are mounted on preferably on each side hull 26 of the watercraft 12 and extend outside the hull upon command. A nut 31 with a collapsible sleeve 30 is provided at each of the bolt 24.

Alternatively, a quick acting nut and bolt can be secured to the terminal portion of the shaft extending outside the hull of the watercraft 12. Yet in another aspect of the invention, a mechanical clamping means is provided at the terminal portion of the shaft outside the hull of the watercraft 12.

All modern vessels have double hull design. As illustrated in FIG. 6, the hijacked vessel 10 having double hull vessel includes two independent hulls 42, 44, one inside the other, with the two hulls 42, 44 spaced from one another and a common deck extending over the hulls. Both hulls include watertight, pressure-resistant side walls and bottoms. The explosive tipped shaft only punctures the outer hull of the hijacked vessel 42.

While the two vessels are held together by electromagnetic force 46, a system of explosive activated or quick acting mechanical bolts 24 held in the watercraft 12 are activated to create openings on the outer hull 42 of the hijacked vessel 10, allowing fastening of bolt and nut to further secure the watercraft 12 to the hijacked vessel 10. Alternatively the vessels can be mechanically clamped. Once mechanically fastened, the watercraft 12 is inseparable from the hijacked vessel 10.

Figure 8:
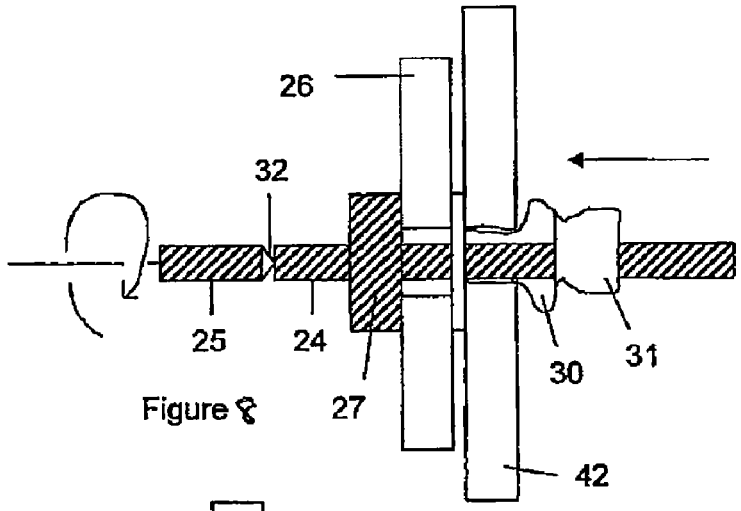
FIG. 8 illustrates a collapsible sleeve of the bolt deforming and wedging into the hijacked vessel's hull.
Figure 9:
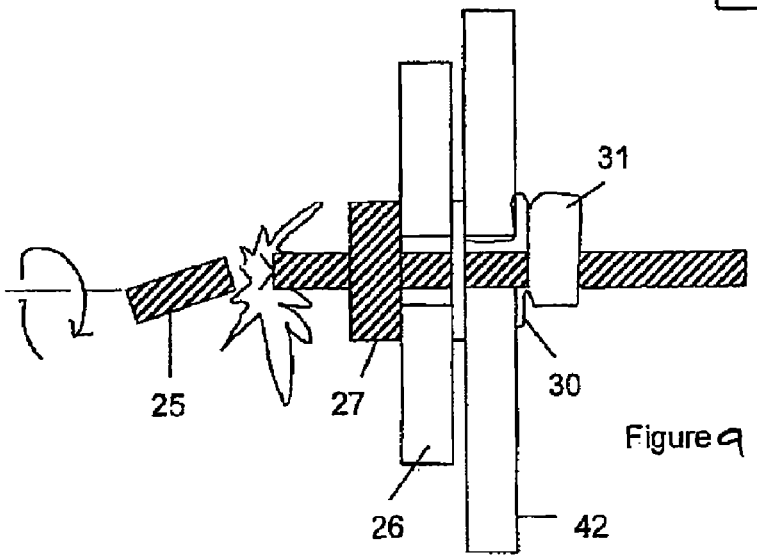
FIG. 9 illustrates the separation of bolt with motor when required torque is achieved.

Referring to FIGS. 7 to 9, the explosive-activated mechanical bolt 24 consists of an elongated shaft 25 extending from within the watercraft 12 through the side hull 26 of the watercraft 12. The shaft 25 is secured in position by a bolt 27 on the inner wall of the watercraft 12 and a water sealant member 29 on the outside wall. The outside exposed section of the bolt includes a nut 31 with collapsible sleeve 30. The shaft 25 includes a point of weakness 32 along its length and is connected to a motor (not shown). The explosive at the tip of the bolt can be detonated by a fuse initiated electronically upon command. The motor is powered by the onboard generator to provide a quick and powerful means of turning and tightening the bolt and nut. On triggering the explosive head 22, an opening 34 is created on the outer hull 42 of the hijacked vessel 10. The opening 34 is sufficient to accommodate the diameter of the shaft of bolt and nut 31 to go through. Once the shaft 25 and nut 31 is inside the hijacked vessel's hull, the bolt 24 is rotated by means of the motor secured to the shaft 25 as illustrated in FIG. 8. This rotational movement of the shaft tightens the nut 31 against the outer hull 42 of the hijacked vessel 10 and simultaneously the collapsible sleeve 30 of the bolt deforms and wedges onto the opening 34 created by the explosion. Referring to FIG. 9, further rotation of the shaft 25 results in the shearing of the shaft 25 at the point of weakness 32, resulting in the portion of the shaft 25 being detached free from the rest of the shaft 25.

Each of the watercrafts may be secured to the side of the sailing vessel's (10) hull by a suitable temporary non-destructive, releasable attaching means including any one or in combination of electromagnetic means (such as a solenoid bank), vacuum suction means; and mechanical clamping or hook means. A number of such attaching means are disclosed in our co-pending International Patent Application No. PCT/SG2005/000178 filed on 3 Jun. 2005 which disclosure is incorporated herein by reference.

The first watercraft's temporary attaching means may be used advantageously to quickly secure the watercraft (12, 14) to the vessel's hull while a more secure or permanent attaching means is being put in place. Such secure attaching means may include explosive-propelled hull-piercing mechanical clamping means (e.g. explosive-activated mechanical bolt).

In addition to yawing, one or more of the watercraft may undertake operations such as rescuing, evacuating, storming and the like whereupon it is capable of freeing itself from said sailing vessel upon completing the undertaking.

It will be appreciated that a number of the above-described features of our invention may be adopted modularly, modified, reconfigured, or alternatively adapted which are still based on the same general concept, features and working principles of the present invention. For example, the method may be adapted for use at the bow of the errant vessel instead of at the stern. In fact, the position of attachment need not be at the bow or stern as it can be attach at any part of the vessel's body except that such position may not be as effective in yawing as it will require bigger propulsion power for the same maneuver, or a longer effective turning radius for the vessel.

Another possible variation is to have both the first and second watercrafts on the same side of the vessel's hull in which direction it is to be yawed. For example, the first watercraft may attach itself to the stern end of the errant vessel's right side while the second watercraft may attach itself to the bow end on the same, i.e. right side. To yaw the vessel to turn clockwise, the first watercraft may operate its propulsion system to direct the thrust away from the hull so that the stem portion of the vessel is pushed leftwards, thereby causing the vessel to turn rightwards while the second watercraft remains on standby. To change the direction of turning, the first watercraft may stop operating its directional propulsion and allow the second watercraft to direct its propulsion thrust away from the bow end of the hull so that the bow end is pushed leftwards, thereby causing the vessel to turn leftwards.

While this invention has been described in connection with specific embodiments thereof, it will be understood that it is capable of further modification(s). This application is intended to cover any variations uses or adaptations of the invention following in general, the principles of the invention and including such departures from the present disclosure as come within known or customary practice within the art to which the invention pertains and as may be applied to the essential features hereinbefore set forth.

As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the appended claims. Various modifications and equivalent arrangements are intended to be included within the spirit and scope of the invention and appended claims. Therefore, the specific embodiments are to be understood to be illustrative of the many ways in which the principles of the present invention may be practiced. In the following claims, means-plus-function clauses are intended to cover structures as performing the defined function and not only structural equivalents, but also equivalent structures. For example, although a nail and a screw may not be structural equivalents in that a nail employs a cylindrical surface to secure wooden parts together, whereas a screw employs a helical surface to secure wooden parts together, in the environment of fastening wooden parts, a nail and a screw are equivalent structures.

"Comprises/comprising" when used in this specification is taken to specify the presence of stated features, integers, steps or components but does not preclude the presence or addition of one or more other features, integers, steps, components or groups thereof."

We claim:

1. A method of intercepting and yawing an errant sailing vessel comprising the steps of:

(a) dispatching at least a first watercraft to approach said sailing vessel;

(b) securing said first watercraft to one side of said sailing vessel's hull;

(c) operating said first watercraft to direct propulsion to yaw said sailing vessel in a desired direction, wherein said first watercraft employs securing means to secure said first watercraft to the sailing vessel's hull in a permanent or secure manner, including employing explosive aided hull-piercing mechanical clamping;

wherein the steps of employing securing means to secure said first watercraft to one side of said sailing vessel's hull include:

extending a bolt having an explosive-embedded tip from the first watercraft toward the sailing vessel;

activating an explosive in the explosive-embedded tip upon the explosive-embedded tip contacting the sailing vessel's hull to create an opening on the one side of the sailing vessel for the bolt to penetrate the opening, the bolt further comprising a nut and a collapsible sleeve at an end of the bolt wherein the nut and collapsible sleeve penetrates the opening of the sailing vessel's hull;

deforming the collapsible sleeve against an inside of the opening of the sailing vessel's hull by rotating the bolt operatively connected to a motor, forming a wedge by the collapsible sleeve that is collapsed and allowing the nut to be tightened thereby securing the first watercraft to the one side of the sailing vessel in a permanent or secure manner.

2. A method according to claim 1 wherein (a) at least a second watercraft is further dispatched to approach said sailing vessel;

(b) securing the first watercraft to one side of said sailing vessel's hull;

(c) securing at least said second watercraft to the other side of said sailing vessel's hull;

(d) operating at least one of said watercrafts to direct propulsion to yaw said sailing vessel in a desired direction.

3. A method, according to claim 1 wherein the first watercraft is secured proximate to said sailing vessel's stern and operated to direct propulsion away from said sailing vessel's hull to push and yaw said sailing vessel to a direction on the same side of the hull to which said first watercraft is secured.

4. A method, according to claim 2 wherein the second watercraft is secured proximate to said sailing vessel's stern and operated to direct propulsion away from said sailing vessel's hull to push and yaw said sailing vessel to a direction on the same side of the sailing vessel's hull to which said second watercraft is secured.

5. A method according to claim 4 wherein said second watercraft is secured proximate to said sailing vessel's stern and is not operated to direct propulsion with respect to said vessel's direction of sailing vessel.

6. A method according to claim 4 wherein the yawing direction is changed midway of yawing when the first watercraft's direct propulsion, is halted and the second watercraft is operated to direct propulsion away from, said sailing vessel's hull to push and yaw said sailing vessel to a direction on the same side of the sailing vessel's hull to which said second watercraft is secured.

7. A method according to claim 2 wherein the direction at yawing is predetermined and wherein the first watercraft is secured on one side of the sailing vessel's hull proximate to the sailing vessel's stern and operated to direct propulsion away from said sailing vessel's hull, and the second watercraft is secured on the other side of the sailing vessel's hull proximate to the sailing vessel's bow and operated to direct propulsion away from said sailing vessel's hull.

8. A method according to claim 2 wherein the direction of yawing is predetermined and wherein the first watercraft is secured on one side of the sailing vessel's hull proximate to the sailing vessel's stern and operated to direct propulsion away from said sailing vessel's hull and push against said sailing vessel's hull, and the second watercraft is secured on the same side of the sailing vessel's hull proximate to the sailing vessel's bow and operated to direct propulsion to pull said sailing vessel's hull towards said second watercraft.

9. A method according to claim 2 wherein at least one of the first watercraft and said second watercraft is secured to the side of sailing vessel's hull by a temporary non-destructive releasable attachment which includes at least one selected from the group consisting of:

an electromagnetic;

a vacuum suction; and a mechanical clamping or hook.

10. A method according to claim 9 wherein said at least one of the first watercraft and said second watercraft that is secured to the side of sailing vessel's hull by the temporary non-destructive releasable attachment is capable of freeing itself from said sailing vessel upon completing its undertaking.

* * * * *